US006905190B1

(12) United States Patent
Otsuka et al.

(10) Patent No.: US 6,905,190 B1
(45) Date of Patent: Jun. 14, 2005

(54) TWO-WAY PRINT APPARATUS AND PRINT METHOD

(75) Inventors: Naoji Otsuka, Yokohama (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/702,765

(22) Filed: Nov. 1, 2000

(30) Foreign Application Priority Data

Nov. 4, 1999 (JP) ..... 11-313790

(51) Int. Cl.[7] ..... B41J 2/145; B41J 2/15
(52) U.S. Cl. ..... 347/40
(58) Field of Search ..... 347/40, 43, 15, 347/9, 12, 41

(56) References Cited

U.S. PATENT DOCUMENTS

| | | | | | |
|---|---|---|---|---|---|
| 4,528,576 | A | | 7/1985 | Koumura et al. | 347/15 |
| 4,593,295 | A | | 6/1986 | Matsufuji et al. | 347/41 |
| 4,746,935 | A | * | 5/1988 | Allen | 347/40 |
| 6,086,181 | A | * | 7/2000 | Majette et al. | 347/16 |
| 6,254,217 | B1 | * | 7/2001 | Askeland et al. | 347/43 |
| 6,315,387 | B1 | * | 11/2001 | Horikoshi | 347/40 |
| 6,601,937 | B2 | * | 8/2003 | Hotomi et al. | 347/15 |

FOREIGN PATENT DOCUMENTS

| | | | | |
|---|---|---|---|---|
| EP | 1072421 | | 1/2001 | |
| JP | 2-41421 | | 9/1990 | |
| JP | 3-45351 | A * | 2/1991 | 347/43 |
| JP | 3-77066 | | 12/1991 | |
| JP | 7-112534 | | 5/1995 | |

OTHER PUBLICATIONS

Aoyanagi Takeshi; Patent Abstracts of Japan; "Color Recording Apparatus"; Nov. 12, 1996.
Takizawa Tatsuji; Patent Abstracts of Japan; "Color Ink Jet Printer"; Aug. 1, 1995.

* cited by examiner

*Primary Examiner*—Thinh Nguyen
(74) *Attorney, Agent, or Firm*—Fitzpatrick, Cella, Harper & Scinto

(57) ABSTRACT

Two sets of recording heads capable of applying ink of cyan (C), magenta (M), and yellow (Y) and of forming relatively large dots and relatively small dots are arranged in symmetry in a scanning direction and orders of colors C and M ejected in respective dot sizes onto a pixel of a secondary color are set to symmetric orders (C→M and M→C). This makes the application orders of ink for either dot size symmetric in each pixel of secondary color and thus there is no difference between application orders in formation of the pixel by either forward or backward scanning, whereby occurrence of uneven color due to the application orders of ink can be reduced.

26 Claims, 10 Drawing Sheets

PRIOR ART FIG. 12A

PRIOR ART FIG. 12B

TWO-WAY PRINT APPARATUS AND PRINT METHOD

BACKGROUND OF THE INVENTION

1. Field of the Invention

The present invention relates to a two-way (or bidirectional) print apparatus and method for implementing color print by two-way scanning of a recording head for applying ink materials of plural colors in different amounts onto a print medium and, more particularly, to a two-way print apparatus and method capable of reducing uneven color occurring in two-way color print.

2. Related Background Art

In the field of the print apparatus, particularly, in the field of the print apparatus of the ink jet type, a significant subject is increase in recording speed for color print. Common techniques for increasing the recording speed include increase in recording (driving) frequency of the recording head, two-way print, etc., in addition to increase in the length of the recording head. In comparison with one-way print, the two-way print is an effective means in terms of cost as a total system, because necessary energy is dispersed on a time basis in order to gain equal throughput.

The two-way print methods, however, had a principle-based problem that uneven color occurred in a bandlike shape, because an ejection (or application) order of the ink materials of the respective colors was different in the forward direction of main scan from that in the backward direction, depending upon the recording device, particularly, depending upon the structure of the recording head. Since this problem is caused by the ejection orders of the ink materials, it appears as difference in coloring more or less where dots of different colors overlap even a little, as discussed below.

When an image is formed by applying the color materials such as pigment or dye ink materials or the like onto a print medium, an ink material of a precedently recorded dot first dyes the print medium from the surface layer to the inside of the print material. In a case whose an ink material for formation of a subsequent dot is laid in an at least partly overlapping state on the precedently recorded dot on the print medium, a large amount of ink dyes the medium in the part below the portion already dyed by the preceding ink, and thus the precedently applied ink tends to color stronger. For that reason, in the case of the conventional devices where ejection nozzles of the respective colors were arranged in the main scanning direction, since the ejection order of the ink materials in backward scanning was reverse to that in forward scanning in the two-way print, the difference of coloring caused the bandlike uneven color.

This phenomenon is not limited to only ink, but also occurs similarly with wax-based color materials and the like for process color because of the precedent-subsequent relation, though the principles are different.

Ink jet printers supporting the two-way print heretofore were constructed to avoid this problem by the following techniques.

1) To allow uneven color; or to implement the two-way print of only black (Bk).

2) To arrange the nozzles of the respective colors in the sub-scanning direction, i.e., arrange them in so-called vertical layout.

3) To provide forward nozzles and backward nozzles and switch between nozzles or heads to be used for forward scanning and for backward scanning so as to equate ejection orders of colors (refer to Japanese Patent Publication No. 03-77066).

4) To implement interlace print for rasters printed in the forward scanning and in the backward scanning, so as to complementarily cause uneven color due to difference between ejection orders at high frequency per recorded raster, thereby achieving visually uniform appearance (refer to Japanese Patent Publication No. 02-41421 and Japanese Patent Application Laid-Open No. 07-112534).

On the other hand, there is already known a technology of forming an image by combining the dots formed by different liquid droplet sizes (different liquid amounts), in order to achieve both higher image quality and a higher printing speed at the same time.

This technology allows to position the dots of different sizes within an image, and to obtain a print of higher quality with a higher speed, by forming a portion of lower granularity of the image with the relatively smaller liquid droplets and by efficiently painting a wide portion of the image with the relatively larger liquid droplets being smaller in the number of droplets.

For exploiting this technology, there have conventionally been proposed two methods, namely, in a printing apparatus equipped with a recording head capable of discharging liquid droplets of at least two sizes, or a relatively larger droplet size and a relatively smaller droplet size:

A) a method of printing with the liquid droplets of a single size selected for example according to the image resolution; and B) a method of printing with the dots of at least two droplet sizes, in mixed manner according to the gradation data.

However, in executing the two-way print, the above prior art 1) was not an essential solution and had such a drawback that the throughput was considerably lowered in the case of inclusion of a color image. The vertical layout of 2) realized the equal ejection orders in the forward scanning and in the backward scanning, but it had such a drawback that the recording head became long and another drawback of being weak against the difference in coloring due to time difference of ejection between colors.

In the method of 3), though the recording head for forward scanning and the recording head for backward scanning were integrated on a common substrate, this was equivalent to a configuration wherein two completely different recording heads were prepared. Therefore, the method had such a drawback that there occurred the bandlike uneven color with great color difference similar to that due to the difference between heads. For example, in the case where there was difference between temperature-increasing rates of the recording heads due to difference between ratios of forward and backward data from interference with data, there was difference in ejection amounts between the recording heads, and the uneven color occurred in the bandlike shape.

The method 4) was a technique of causing regular uneven color at high frequency so as to make the uneven color unlikely to be visually perceived, and for that reason, the color difference was enhanced in certain cases because of interference, depending upon print data. For example, in a configuration where the color difference was made per raster, great color difference appeared if there existed portions with high incidence of only even rasters and portions with high incidence of only odd rasters in the forward scanning and in the backward scanning in a half-tone area such as a mesh area or the like.

Also in either of the aforementioned color printing methods A and B utilizing the different liquid droplet sizes, when the recording heads of different colors are arranged in the main scanning direction that is, they are configured with the horizontal arrangement, one-pass bidirectional printing results in a significant unevenness between the scans in two directions as in the aforementioned methods 3) and 4).

SUMMARY OF THE INVENTION

The present invention has been accomplished in order to solve the above problems and an object of the present invention is thus to provide a two-way print apparatus and method capable of reducing occurrence of uneven color due to scanning directions even in the two-way color print.

Further, another object of the present invention is to provide a two-way print apparatus and method capable of reducing occurrence of uneven color due to scanning directions, irrespective of print data.

In order to accomplish the above objects, the present invention provides a print apparatus capable of forming a color image by applying ink materials of plural colors in different amounts onto a print medium while scanning a recording head in two directions, wherein, in order to make orders of application of an ink material of a certain color out of ink materials of plural colors applied in at least one kind of amount onto a pixel area of a secondary color to form the secondary color, symmetric with respect to an ink material of another color, at least the ink material of said certain color is applied plural times onto said pixel area.

Further, the present invention provides a print apparatus capable of forming a color image by applying ink materials of plural colors in different amounts onto a print medium while scanning the print medium in two directions with a recording head, wherein, in order to make orders of application of an ink material of a certain color out of ink materials of plural colors applied onto in at least one kind of amount a pixel area of a process color to form the process color, symmetric with respect to an ink material of another color, at least the ink material of said certain color is applied plural times onto said pixel area.

Further, the present invention provides a print method capable of forming a color image by applying ink materials of plural colors in different amounts onto a print medium while scanning a recording head in two directions, the print method comprising:

a first step of applying an ink material of a certain color in at least one kind of amount for forming a secondary color on a pixel area of the secondary color, onto said pixel area;

a second step of applying an ink material of another color in said amount onto said pixel area for forming the secondary color in combination with said certain color, after the application of the ink of said certain color; and a third step of applying the ink material of said certain color in said amount onto said pixel area, after the application of the ink of said another color.

Further, another print method according to the present invention is a print method capable of forming a color image by applying ink materials of plural colors in different amounts onto a print medium while scanning a recording head in two directions, the print method comprising:

a first step of applying an ink material of a certain color for forming a secondary color on a pixel area of the secondary color and an ink material of another color for forming said secondary color in combination with said certain color, in the order named, in at least one kind of amount onto said pixel area; and a second step of applying the ink material of said certain color and the ink material of said another color in an order symmetric with said order, in said amount onto said pixel area.

According to the above, the ink applied in the symmetric application orders and in at least one kind of amount is dominant in the pixel area of the process color including the secondary color. Therefore, there is no difference between the application orders in formation of the pixel area in the forward scanning and in the backward scanning, so that it becomes feasible to reduce the uneven color due to the application orders of ink.

The "print medium" stated herein is not limited to only ordinary paper used in the print apparatus, but also generally means any medium capable of accepting ink, including fabric, plastic film, metal sheet, and so on.

The "ink" or "ink materials" should also be interpreted in a broad sense, similar to the definition of the above "print," and mean color materials capable of being used for formation of image, chart, pattern, etc. or for process of the print medium when applied onto the print medium.

Further, the "pixel area" means a minimum area for expressing a primary color or a secondary color when an ink material or a plurality of ink materials are applied thereonto, and includes a super pixel and a sub-pixel as well as a pixel. The number of scans necessary for completion of the pixel area is not limited to one, but may be two or more.

Further, the "process color" means a color resulting from coloring of ink materials of three or more colors mixed on the print medium, including the secondary color.

BRIEF DESCRIPTION OF THE DRAWINGS

FIGS. 12A, 12B and 12C are views showing the arrangement of nozzles of a relatively larger discharge amount and those of a relatively smaller discharge amount.

DESCRIPTION OF THE PREFERRED EMBODIMENTS

Figure 3:
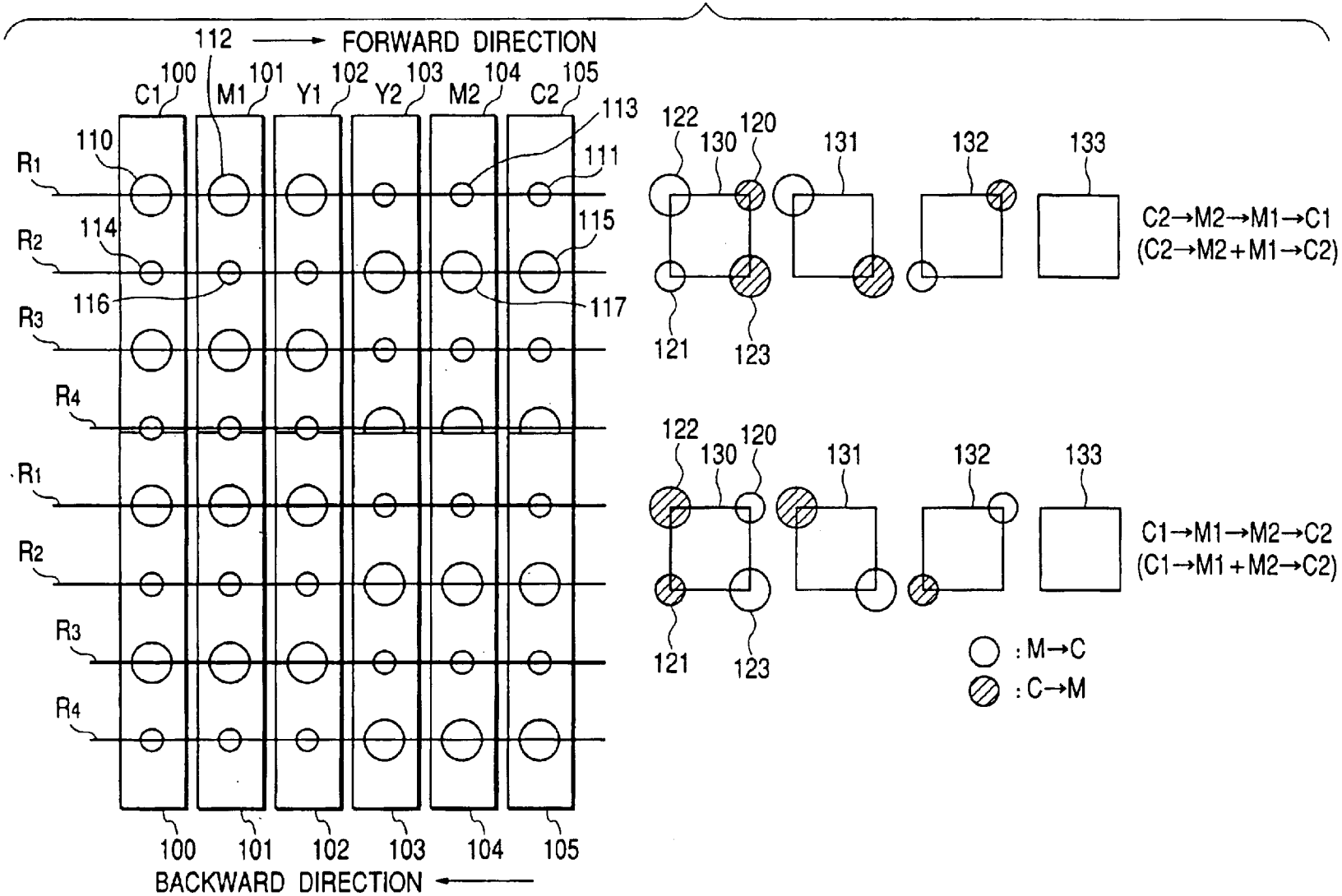
FIG. 3 is a view showing an example of the arrangement of a recording head and discharge nozzles, and configurations of a pixel in an embodiment 1.

In an embodiment of the present invention, employing a recording head of a configuration in which the recording nozzles of different colors capable of ejecting inks of different amounts are arranged in a symmetrical order at least in the main scanning direction as shown in FIG. 3, it is preferred to eject the inks from the nozzles of different colors onto the print medium in such a manner that the order of ejection of the inks of different colors, ejected with at least one kind of amount, becomes symmetrical. It is thus rendered possible to alleviate the color unevenness resulting from the bidirectional printing, based on the synchronization with the form data themselves such as the horizontal form lines or with the halftoning data such as dither data.

The embodiments of the present invention will be described below in detail with reference to the drawings. In the drawings, elements indicated by the same reference symbols denote like or equivalent elements.

Figure 1:
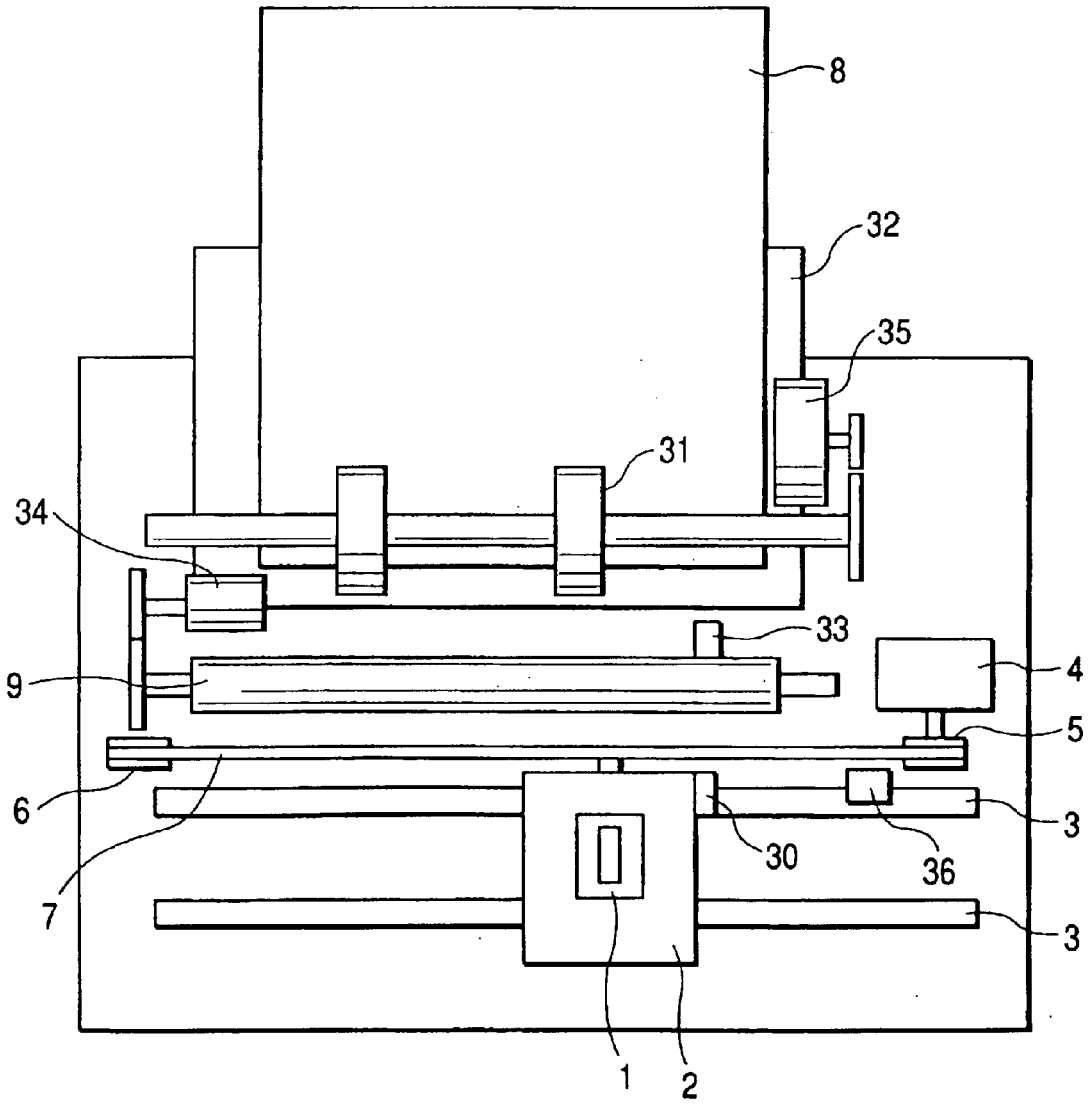
FIG. 1 is a schematic view showing the configuration of an ink jet printing apparatus constituting an embodiment of the present invention.

FIG. 1 is a diagram to show the structure of the principal part in an embodiment of the ink jet print apparatus according to the present invention.

In FIG. 1, a head cartridge 1 is mounted in a replaceable state on a carriage 2. The head cartridge 1 has a print head section and an ink tank section and is provided with a connector (not illustrated) for transmitting and receiving signals for driving the head section and others.

The head cartridge 1 is positioned and mounted in the replaceable state on the carriage 2 and the carriage 2 is provided with a connector holder (electrical connection) for transmitting driving signals, etc. through the aforementioned connector to each head cartridge 1.

The carriage 2 is guided and supported so as to be movable forward and backward along a guide shaft 3 extending in the main scanning direction and set on the main body of apparatus. The carriage 2 is driven through a driving mechanism consisting of a motor pulley 5, a driven pulley 6, a timing belt 7, etc. by a main scanning motor 4 and the position and movement thereof are controlled thereby. A home position sensor 30 is disposed on the carriage. This permits the apparatus to detect the position when the home position sensor 30 on the carriage 2 passes the position of a shield plate 36.

Print media 8 such as print sheets, plastic thin films, or the like are separated and fed one by one from an auto sheet feeder (hereinafter referred to as ASF) 32 by rotating pickup rollers 31 via gears by a sheet feed motor 35. Further, with rotation of carry rollers 9, a print medium is carried (sub-scanned) through the position (print section) opposite to an ejection port surface of the head cartridge 1. The carry rollers 9 are rotated via gears with rotation of LF motor 34. On that occasion, it is determined whether the medium has been fed and the position of the leading end of the medium in the feed operation is determined, when the print medium 8 passes a paper end sensor 33. Further, the paper end sensor 33 is also used for detecting the actual position of the rear end of the print medium 8 and finally determining a current recording position from the actual rear end.

The print medium 8 is supported by a platen (not illustrated) on the back surface thereof so as to form a flat print surface in the print section. In this case, each head cartridge 1 mounted on the carriage 2 is held so that its ejection port surface projects downward from the carriage 2 and is parallel to the print medium 8 between the aforementioned pair of two carry rollers.

The head cartridge 1 is, for example, an ink jet head cartridge for ejecting ink by use of thermal energy, which is provided with electrothermal transducers for generating thermal energy. The print head of the head cartridge 1 is designed to implement the print by ejecting ink from each ejection port while making use of pressure of a bubble formed by film boiling due to the thermal energy applied by the above electrothermal transducer. Of course, the ejection method can also be selected from other methods including ejection of ink by piezoelectric elements or the like.

Figure 2:
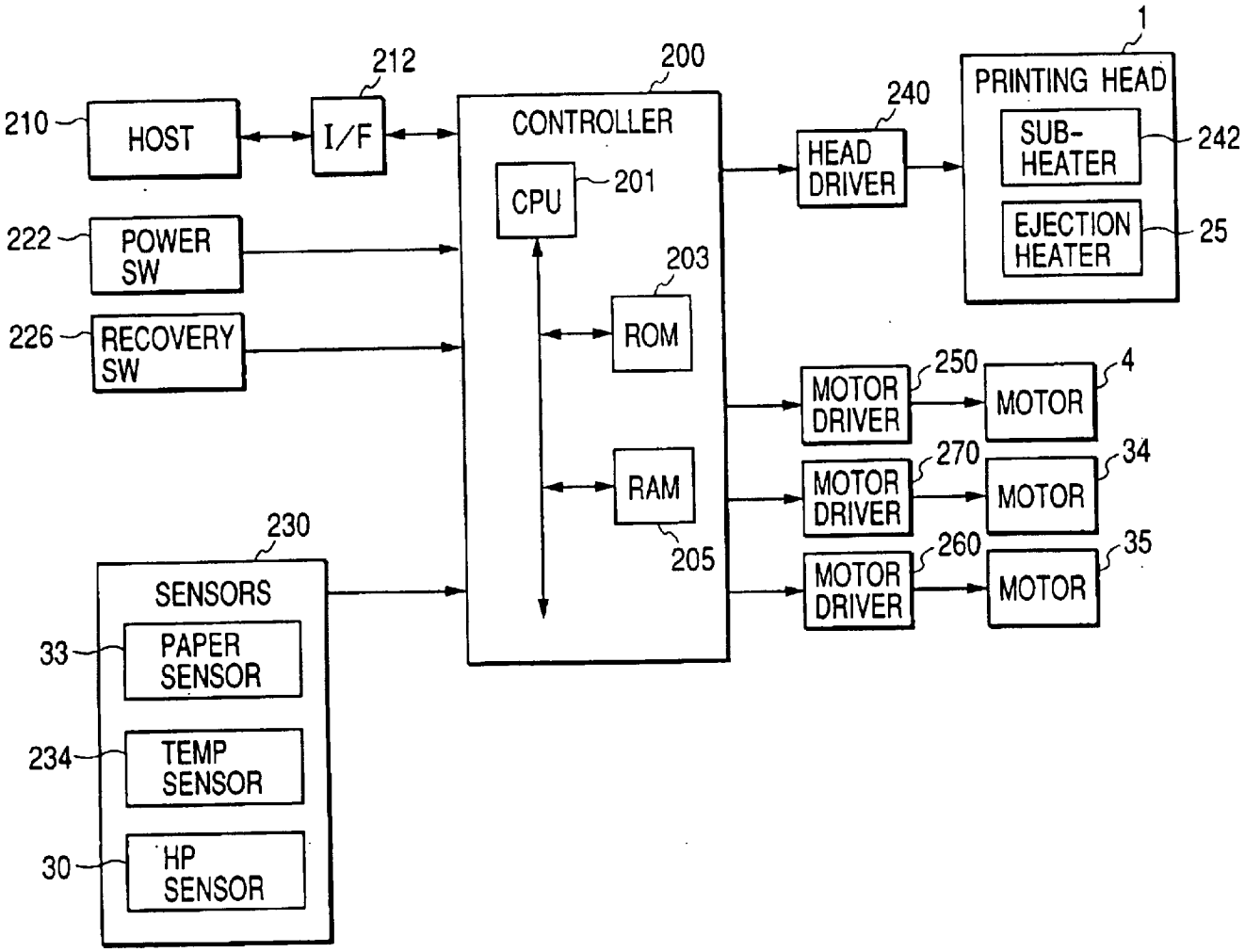
FIG. 2 is a block diagram showing the configuration of a control circuit of the printing apparatus.

FIG. 2 is a block diagram to show an example of schematic structure of a control circuit in the above ink jet print apparatus.

In FIG. 2, a controller 200 is a main control unit, which is, for example, one having a CPU 201 of a microcomputer form, a ROM 203 storing programs, necessary tables, and other fixed data, and a RAM 205 including an area for expansion of image data, a working area, and so on. A host device 210 is an image data supply (which can be a computer for performing preparation, processing, etc. of data of an image or the like associated with the print, or a form of a reader part or the like for reading of an image). The image data, other commands, a status signal, etc. are sent or received through an interface (I/F) 212 to or from the controller 200.

A control section 120 has switches for accepting entry of instructions by an operator, which include a power switch 222, a recovery switch 226 for giving instructions for actuating suction recovery, and so on.

Sensors 230 are sensors for detecting the status of the apparatus, which include the aforementioned home position sensor 30, the paper end sensor 33 for detecting presence or absence of the print medium, a temperature sensor 234 disposed at an appropriate position for detecting the ambient temperature, and so on.

A head driver 240 is a driver for driving ejection heaters 25 of the print head 1 according to print data or the like. The head driver 240 has a shift register for aligning the print data corresponding to positions of ejection heaters 25, a latch circuit for latching signals at appropriate timing, and a logic circuit element for actuating the ejection heaters in synchronism with driving timing signals and, in addition thereto, has a timing setting section for appropriately setting the driving timing (ejection timing) for alignment of forming positions of dots, and so on.

The print head 1 incorporates sub-heaters 242. The sub-heaters 242 are heaters for temperature control to stabilize ejection characteristics of ink and can be constructed in a form wherein they are built together with the ejection heaters 25 on a print head substrate and/or in a form wherein they are mounted on the print head body or on the head cartridge.

A motor driver 250 is a driver for driving the main scanning motor 4, the sub-scanning motor 34 is a motor used for conveying (or sub-scanning) the print medium 8, and a motor driver 270 is a driver for the motor 34.

The sheet feed motor 35 is a motor used for separation and feed of the print medium 8 from the ASF and a motor driver 260 is a driver for the motor 35.

(Embodiment 1)

FIG. 3 is a schematic diagram to partially show the structure of the principal part of the recording head section in the head cartridge 1. In FIG. 3, numeral 100 designates a first recording head (hereinafter referred to as C1) for ejecting cyan ink. Numeral 101 denotes a first recording head (M1) for ejecting magenta ink. Numeral 102 is a first recording head (Y1) for ejecting yellow ink. Numeral 103 represents a second recording head (Y2) for ejecting yellow ink. Numeral 104 indicates a second recording head (M2) for ejecting magenta ink. Numeral 105 is a second recording head (C2) for ejecting cyan ink. Further, the head cartridge may also be provided with a recording head of Bk in addition to the above heads.

The above-mentioned recording heads are collectively constructed to constitute the head cartridge 1, in which each recording head is provided with plural ejection nozzles. As an example, in the recording head 100 C1, There are provided ejection nozzles 110 for discharging (or ejecting) relatively larger cyan liquid droplets. In the recording head 101 M1, there are provided ejection nozzles 112 for discharging relatively larger magenta liquid droplets. In the recording head 104 M2, there are provided ejection nozzles 113 for discharging relatively smaller magenta liquid droplets. In the recording head 105 C2, there are provided ejection nozzles 111 for discharging relatively smaller cyan liquid droplets. Nozzles 114 to 117 are provided in a similar manner.

The nozzles in each recording head are provided substantially perpendicular to the main scanning direction. More strictly, they may be provided in a somewhat slanted manner to the main scanning direction, in consideration of the timing of discharges. Also these recording heads are arranged in a direction parallel to the main scanning direction. More specifically, in the example shown in FIG. 3, the recording heads 100 C1, 101 M1, 102 Y1, 103 Y2, 104 M2 and 105 C2 are arranged parallel to the main scanning direction.

In the two recording heads for each color, the nozzle discharging the relatively larger liquid droplet and the nozzle discharging the relatively smaller liquid droplet are arranged alternately and in the inverted manner, so that the nozzles discharging the liquid droplets of a same amount are mutually displaced by a pitch of arrangement.

As the nozzles are arranged with a pitch of 720 dpi, the nozzles discharging the relatively larger liquid droplets, or those discharging the relatively smaller liquid droplets are arranged with a pitch of 360 dpi.

FIG. 3 also shows a case where dot positions 122, 123 of a pixel 130 are respectively given dots formed by the relatively larger liquid droplets of cyan and magenta, while dot positions 120, 121 are respectively given dots formed by the relatively smaller liquid droplets.

The dot position 122 in FIG. 3 indicates a position regarding the pixel area 130, where the dot is formed by the droplet discharged from the nozzle 110 of the recording head 100 C1 and by that discharged from the nozzle 112 of the recording head 101 M1. Likewise, the dot position 123 indicates a position regarding the pixel area 130, where the dot is formed by the droplet discharged from the nozzle 117 of the recording head 104 M2 and by that discharged from the nozzle 115 of the recording head 105 C2. In FIG. 3, the dot position 122 indicates an upper left corner position while the dot position 123 indicates the lower right corner position.

Also the dot position 120 in FIG. 3 indicates a position regarding the pixel area 130, where the dot is formed by the droplet discharged from the nozzle 113 of the recording head 104 M2 and by that discharged from the nozzle 111 of the recording head 105 C2. Likewise, the dot position 121 indicates a position regarding the pixel area 130, where the dot is formed by the droplet discharged from the nozzle 114 of the recording head 100 C1 and by that discharged from the nozzle 116 of the recording head 101 M1. In FIG. 3, the dot position 120 indicates an upper right corner position while the dot position 121 indicates the lower left corner position.

There are also shown main scanning lines or rasters R1 to R4 constituting pixels. In the illustrated example, a pixel is constituted by two rasters.

Consequently, each pixel has a resolution of 360 dpi×360 dpi.

In FIG. 3, the inks of respective colors are laid in dot-on-dot configuration for each pixel structure. For example in case of forming blue color as a secondary color, there are employed cyan and magenta colors, but, for example with respect to the dot position 122, in the forward scanning operation, a dot from the magenta nozzle 122 of the recording head 101 M1 is landed onto the print medium at first, and then a dot from the cyan nozzle 110 of the recording head 100 C1 is landed there. According to the aforementioned principle, the dot position 122 normally appears a red-purple color in which the magenta color landed first prevails.

Similarly, with respect to the dot position 3 in the forward scanning operation, a dot from the cyan nozzle 115 of the recording head 104 M2 is landed onto the print medium at first, and then a dot from the magenta nozzle 117 of the recording head 104 M2 is landed there. According to the aforementioned principle, the dot position 123 normally appears a blue-purple (or violet) color in which the cyan color landed first prevails. Also the dot positions 120, 121 where relatively smaller dots are provided how a similar tendency.

Then, in the backward scanning operation, with respect to the dot position 122, the print medium 8 receives at first a dot from the cyan nozzle 110 of the recording head 100 C1, and then a dot from the magenta nozzle 112 of the recording head 101 M1, so that the dot position 122 normally appears a blue-purple (or violet) color in which the cyan color landed first prevails. Similarly with respect to the dot position 123, the print medium receives at first a dot from the magenta nozzle 117 of the recording head 104 M2 at first, and then a dot from the cyan nozzle 115 of the recording head 105 C2, so that the dot position 123 normally appears a red-purple color in which the magenta color landed first prevails. Also the dot positions 120, 121 where relatively smaller dots are provided show a similar tendency.

In FIG. 3, a white circle indicates a dot formed by magenta landed firstly and cyan landed secondly, while a hatched circle indicates a dot formed by cyan landed firstly and magenta landed secondly. Also the dots are positioned at four corners, but such arrangement is not restrictive as long as they are positioned within the pixel area, and it is also possible to arrange all the dots in a dot-on-dot configuration. Also, even in case the dot positions are mutually displaced within the pixel area, the dots generally overlap partially within the pixel area.

As explained in the foregoing, in each pixel, a blue dot in the red-purple side and a blue dot in the blue-purple side are always used in pair. Microscopically, dots mutually different in color are arranged in the diagonal corner positions.

Then, macroscopically, for the pixel 130, both the relatively larger dots and the relatively smaller dots are so configured as to have symmetrical order of ejection (or application). It is therefore possible, in the unit of each pixel, to generate uniform coloring of blue.

As explained in the foregoing, in order to realize the present invention, it is important to prevailingly achieve a state where regarding the colors forming the secondary color, dots are applied in symmetrical order to form a pixel. In the foregoing there has been explained a case of forming blue color as the secondary color by cyan and magenta, but it will be easily understood that the situation is similar for red (magenta and yellow) or green (cyan and yellow). Also it will be easily understood that, in case of a process color exceeding secondary color, a similar effect can be attained if dots of the colors constituting such process color are applied in symmetrical order to the pixel.

A pixel 131 in FIG. 3 indicates an embodiment of the present invention in a state where the relatively larger dots alone are utilized in the same head configuration. Also a pixel 132 in FIG. 3 indicates an embodiment of the present invention in a state where the relatively smaller dots alone are utilized in the same head configuration. A subpixel 133 indicates a state without any printing. In either case, the relatively larger dots or the relatively smaller dots have a symmetrical order of ejection (or application) both in the forward recording operation or in the backward recording operation. It is therefore possible to exhibit uniform coloring of blue in the unit of an entire pixel.

In the foregoing there has been explained a case where each pixel is composed of a combination of at least relatively larger dots and relatively smaller dots, but the present invention is not limited to such case.

More specifically, in a printer capable of representing intermediate gradation levels by different dot sizes, the image may be formed solely by the relatively larger dots or by the relatively smaller dots, depending on the required resolution, and the present invention is also applicable to such case.

Figure 4:
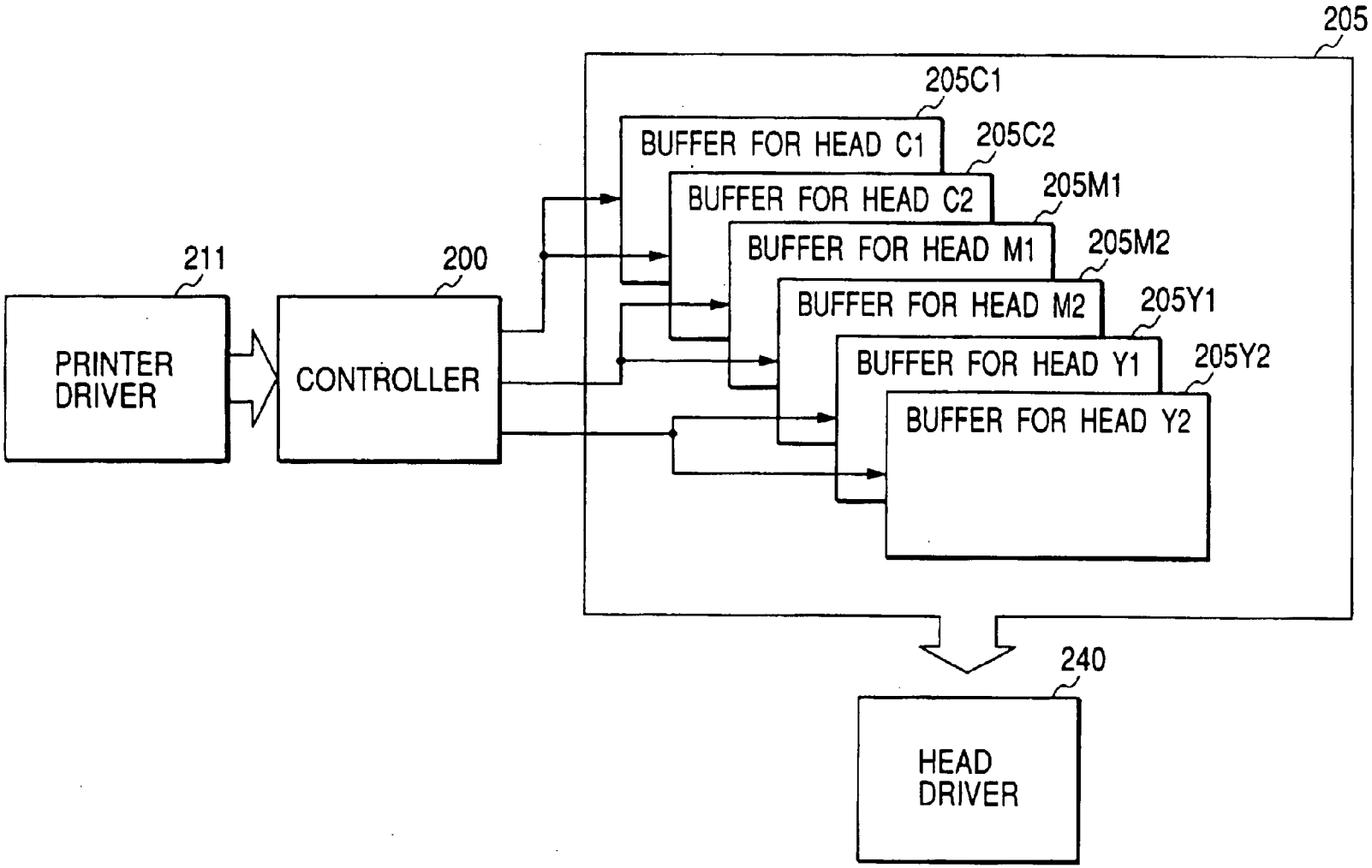
FIG. 4 is a block diagram showing the buffer configuration for the print data in the present invention.

FIG. 4 is a view showing the data buffer structure of the printing apparatus of the present embodiment.

Referring to FIG. 4, a printer driver 221 corresponds to a program, in a host apparatus 210 shown in FIG. 2, for preparing the image data and for transferring the prepared data to the printing apparatus. A controller 200 develops the image data supplied from the printer driver 211 if necessary, and the developed data are written, as 1-bit data for each of C, M and Y colors, in respectively print buffers 205.

In the following there will be considered, as an example, a case of 1-bit cyan data of a resolution of 360 dpi. In the present embodiment, there are written data of 4 bits in total, namely two bits for each of the buffers 205 C1, 205 C2 for the recording heads 100 C1 and 105 C2, respectively. When each recording head reaches the pixel position for actual recording, the data stored in each buffer are read into a register in each recording head for executing the printing operation. Such data and configuration allows to execute printing on the subpixel from the different recording heads, with two dots in a pair. In the foregoing there has been explained the case of utilizing C, M and Y colors, but the situation is same for the C, M, Y and K colors or for other combinations of colors.

In this connection, it is rendered possible to prepare some combinations of dots by the writing method of respective data. For example, in case of employing dots of all the sizes as in the pixel 130 shown in FIG. 3, data "11" are written into the C1 buffer 205 C1 shown in FIG. 4. The data "11" means that the ink is to be discharged from both the nozzle 110 for discharging the relatively larger liquid droplet and the nozzle 114 for discharging the relatively smaller liquid droplet. Similarly, data "11" are written into the buffers 205 M1, 205 M2.

In case of employing dots of relatively larger size only as in the pixel 131 shown in FIG. 3, data "10" are written into the C1 buffer 205 C1. The data "10" mean that the ink is to be discharged only from the nozzle 110 which discharges the relatively larger liquid droplet. Similarly data "01" are written into the C2 buffer 205 C2. The data "01" mean that the ink is to be discharged only from the nozzle 115 which discharges the relatively larger ink droplet. Data are similarly written into the buffers 205 M1, 205 M2.

The printing in case of employing the relatively smaller dots only as shown in the pixel 132 in FIG. 3 can also be achieved by a similar procedure.

The print buffers 205 C1, 205 C2, 205 M1, 205 M2, 205 Y1 and 205 Y2 are provided in the RAM 205.

Also, the symmetrical configuration of the recording head, applicable to the present invention, is not limited to that shown in FIG. 3. For example there can be conceived configurations as shown in FIGS. 5 to 9, but there may also be employed still other configurations as long as the effect of the present invention can be exhibited.

Figure 5:
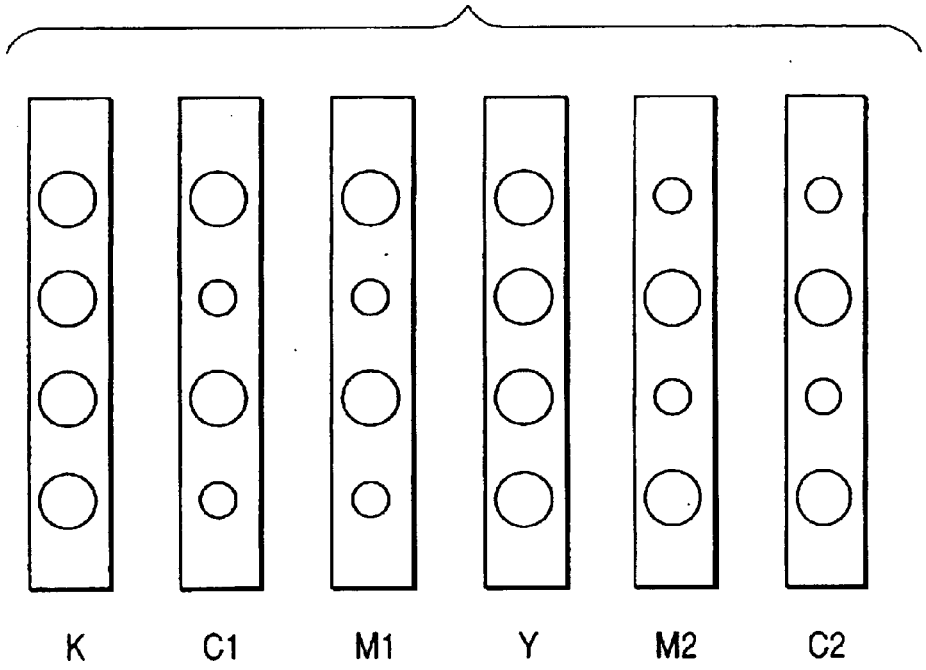
FIG. 5 is a view showing another example of the arrangement of the recording head and the discharge nozzles.

FIG. 5 shows a configuration in which a recording head for depositing black (Bk) ink is added to the left-hand end of the configuration shown in FIG. 3 and only one yellow (Y) recording head is employed at the center of symmetry in order to simplify the configuration. It is noted that the recording head at the center of symmetry always ejects ink later in printing along either direction. In this example, the yellow recording head is selected at the center of symmetry, but such configuration is not restrictive.

Also the black and yellow recording heads have the nozzles discharging the relatively larger liquid droplets only. Because the black color is for obtaining a high image density, and the yellow color is visually less conspicuous.

Figure 6:
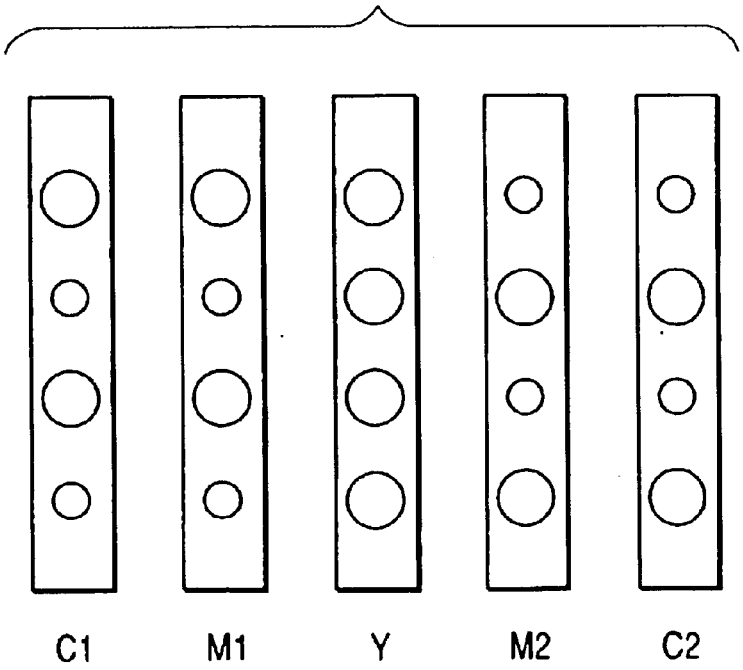
FIGS. 6, 7, 8 and 9 are views showing still other examples of the arrangement of the recording head and the discharge nozzles.

FIG. 6 shows a configuration in which the black recording head is omitted from the configuration shown in FIG. 5.

Figure 7:
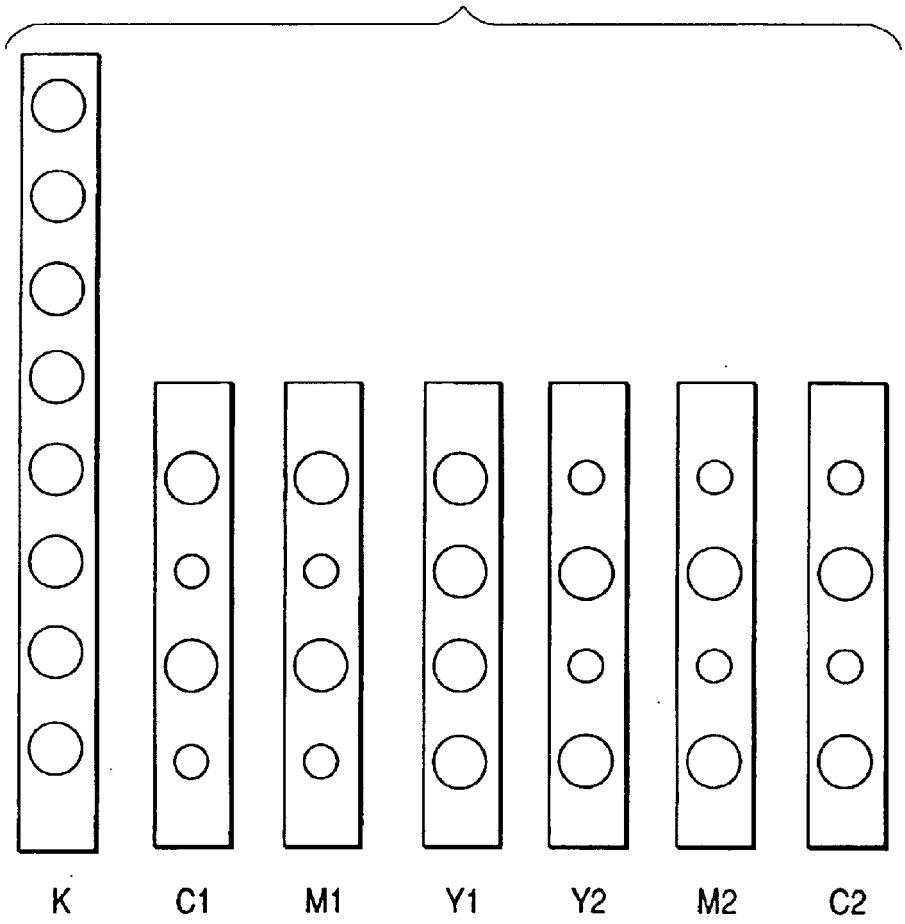

FIG. 7 shows a configuration in which a recording head for depositing black (K) ink is added to the configuration shown in FIG. 3. The black recording head need not be positioned symmetrically because the black color is generally not employed in forming secondary colors, and the black recording head has a larger number of nozzles than in other recording heads, in order to improve the recording speed in the monochromatic recording.

Figure 8:
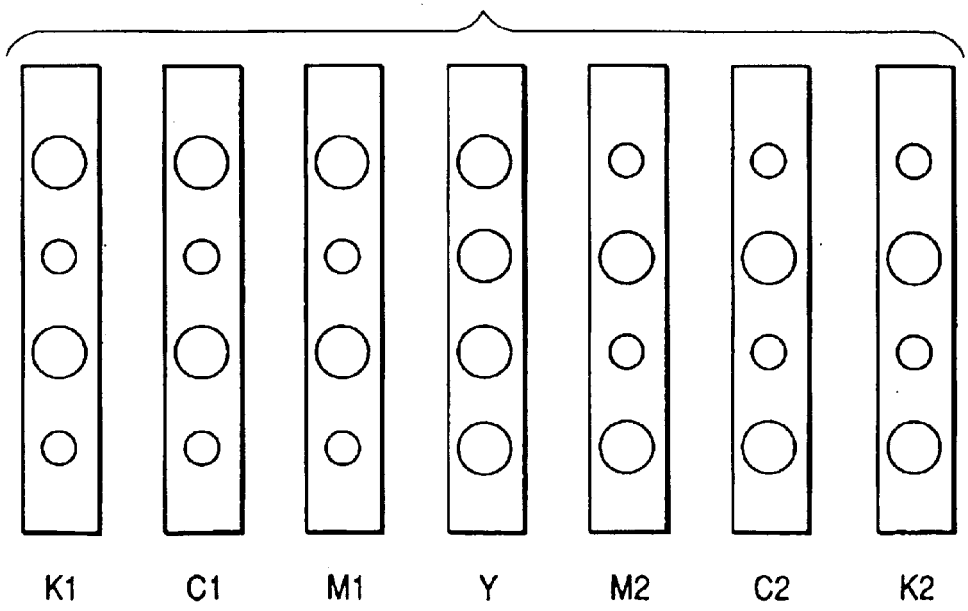

FIG. 8 shows a configuration in which black (K) recording heads in symmetrical arrangement are added to the configuration shown in FIG. 6.

Figure 9:
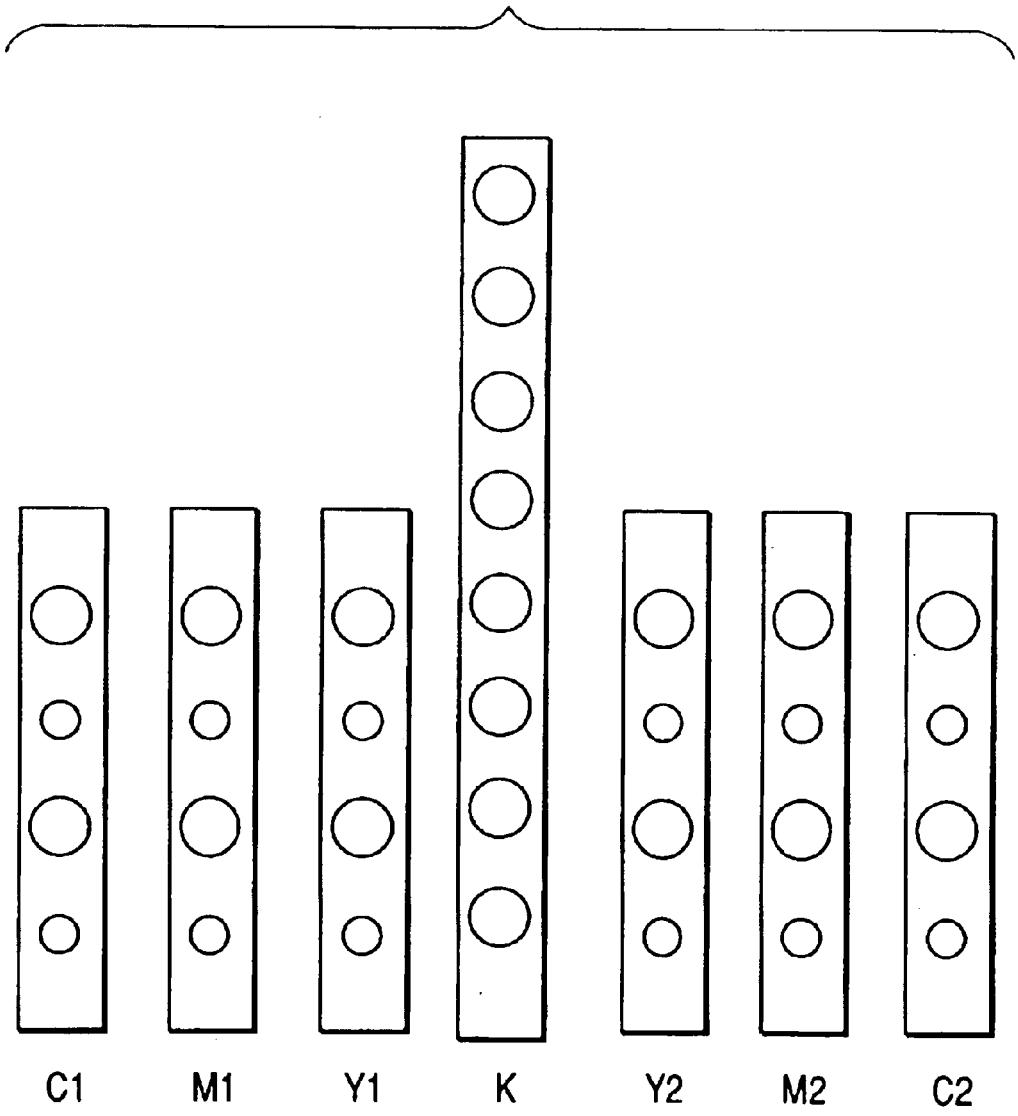

FIG. 9 shows a configuration in which, in the configuration shown in FIG. 7, the black recording head is positioned at the center of symmetry.

(Embodiment 2)

In the foregoing embodiment 1, two dots of a same size are formed as a pair, pairs of different sizes are combined, and the ink of at least one color is ejected in a symmetrical order. Since a pixel is formed by a pair of two dots for each size, such configuration is suitable in case of image formation on a print requiring a maximum density and the increase of the image density, for example, an OHP sheet. However, if the maximum density is not required, there may be employed the relatively larger dots only, or the relatively smaller dots only.

In the present embodiment 2, a high density area is formed by ejecting the ink of at least one color in the symmetrical order as in the foregoing embodiment, while a intermediate gradation area is formed by employing recording heads of a symmetrical configuration designed to match the bidirectional recording and changing the combination of the recording heads in the forward recording operation and in the backward recording operation. In this manner it is rendered possible to exhibit not only the high density area but also the intermediate gradation area in the bidirectional printing.

It has conventional been known that, in so-called horizontal arrangement head in which the recording heads of different colors are arranged along the main scanning direction, the order of ejection becomes different between the forward recording and the backward recording in the bidirectional recording, resulting in the difference in the developed color. For such phenomenon, there has been proposed, as explained in the foregoing in relation to the Japanese Patent Publication No. 3-77066, to arrange a set of the recording heads for the forward recording and a set of those for the backward recording along the main scanning direction and to completely switch such sets for the forward recording and the backward recording in such a manner that the order of ejection remains same. The present invention develops further the above-described prior technology and exploits the advantage of the present invention in combination with such prior technology.

The present embodiment adopts a method of switching the control between the high density area and the low density area as explained above, and provides an advantage of reducing the maximum recording frequency of the recording element to ½ in comparison with the conventional method of completely switching the set of recording heads for the forward recording and the set of those for the backward recording. Stated inversely, it is rendered possible to double the recording speed.

In case of storing the image data in all the addresses in the memory and recording a full solid image, the recording elements have to be operable at the recording frequency capable of setting the dots in all the addresses since, in the prior technology, the forward recording is executed by the recording heads for the forward recording and the backward recording is executed by those for the backward recording. In the prior technology, it has not been possible to position the maximum density in all the addresses so that it has been necessary to reduce the maximum density or to reducing the printing speed.

In the configuration of the present embodiment, the low density area is printed individually by the recording heads for the forward recording or those for the backward recording while the high density area only is printed by both recording elements, so that the recording frequency can be reduced to 12 at maximum for all the addresses. Though the bidirectional unevenness may be generated in the low density area, but image unevenness in the density range close to the maximum density can be significantly improved and the printing speed can be significantly increased. Consequently such configuration can be practically extremely effective.

It is also possible to use all the dot sizes (two sizes in the embodiment) for the maximum density and to use, for the intermediate gradation area, only the relatively larger dots by switching the left and right heads between the forward recording and the backward recording. It is naturally possible also to use the relatively smaller dots for switching. Further, it is possible to use the relatively smaller dots, instead of the relatively larger dots, according to the density. It is furthermore possible to use the combination of plural kinds instead of the combination of the dot sizes.

Also the method of representing the intermediate gradation levels is not limited to that of the present embodiment.

(Embodiment 3)

The concept of the present invention may be further developed to alleviate the color unevenness in the bidirectional printing, even in case there is not employed the recording head of the symmetrical configuration for the bidirectional printing. More specifically, the concept of the foregoing embodiments may be achieved by employing, instead of the one-pass bidirectional printing, multi-pass printing in which a pixel area is completed by plural scanning operations.

Figure 10:
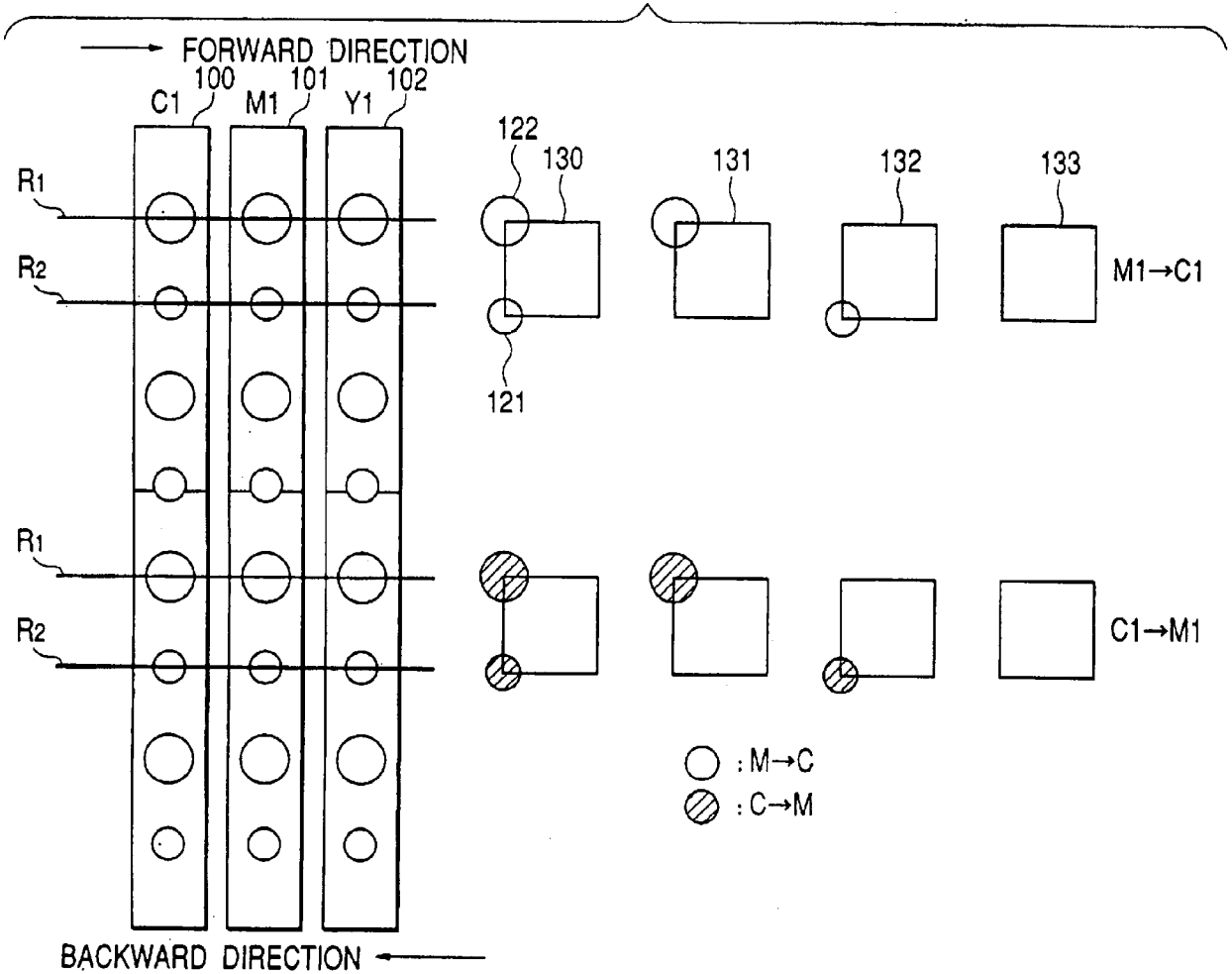
PRIOR ART FIG. 10
FIG. 10 is a view showing the principle of generation of bidirectional color unevenness in a conventional configuration.
Figure 11:
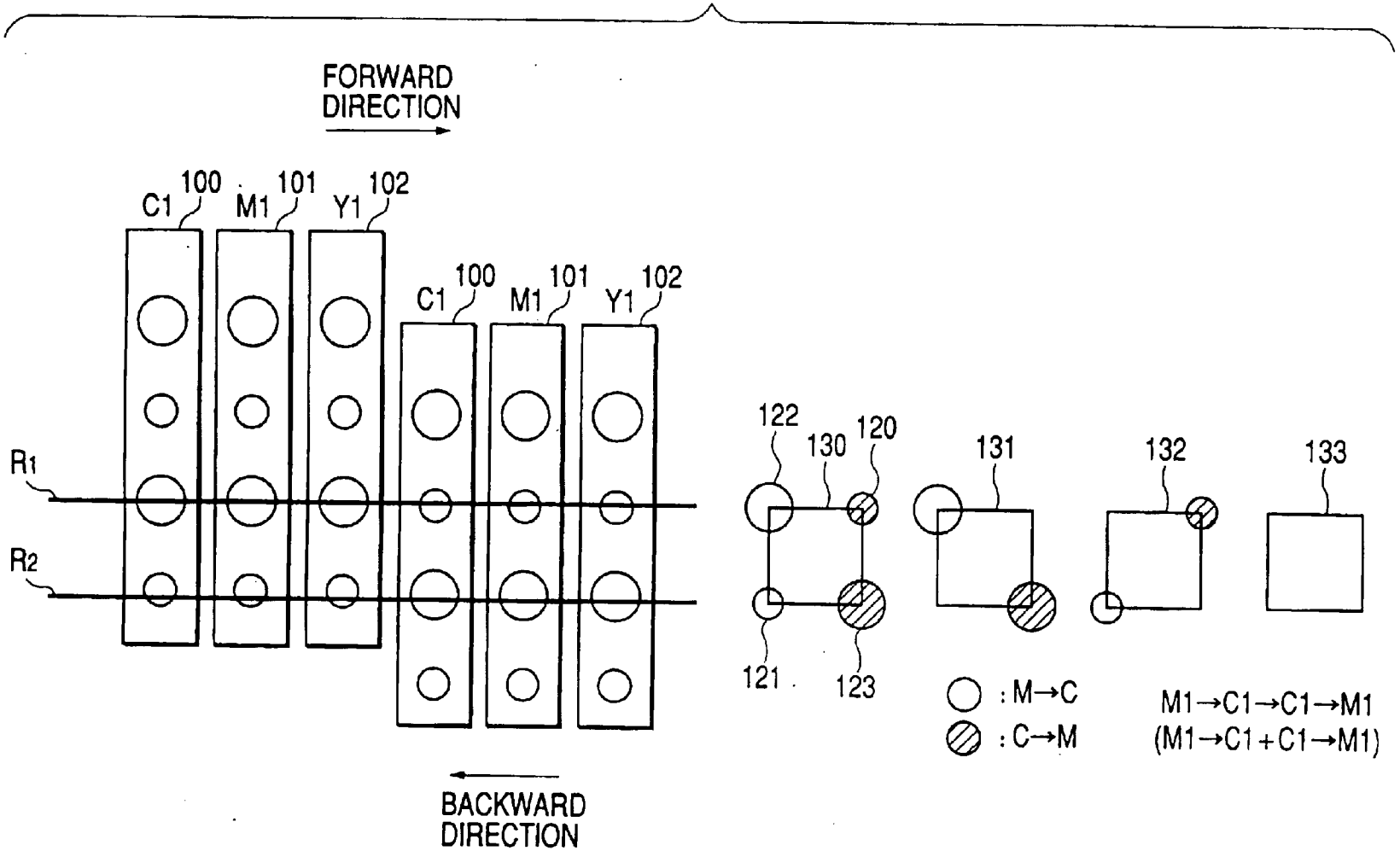
FIG. 11 is a view showing another example of the arrangement of a recording head and discharge nozzles, and configurations of a pixel.

As an example, there will be explained a case of printing a blue dot by the bidirectional multi-pass printing, utilizing a recording head in which the C, M, Y recording elements are arranged in the lateral direction. FIG. 10 shows a conventional case, while FIG. 11 shows an embodiment of the present invention. In the conventional case, the bidirectional printing is simply executed with a configuration with larger and smaller nozzles. On the other hand, in the present embodiment, after the recording head is scanned in the forward direction, the recording head is relatively moved in a sub-scanning direction by a half of the number of the recording element (namely 2 in the illustrated case)±a pitch of the recording elements, namely by 1 pitch and 3 pitches of the recording elements, and the recording head is thereafter scanned in the backward direction to achieve the multi-pass printing.

In the conventional configuration shown in FIG. 10, the order of ejection of the print data is changed by the scanning direction, whereby the color unevenness is generated.

FIG. 11 shown an example of the embodiment of the present invention. In this example, the dots (120, 123) printed in the forward scanning motion and the dots (122, 121) printed in the backward scanning motion are paired to form a pixel, whereby the order of application (or ejection) becomes symmetrical in the dots of each size constituting the pixel and the uniform color can be developed in the bidirectional printing.

Such relationship is satisfied in any of the pixel 130 constituted by the dots of both sizes, the pixel 131 constituted by the dots formed by the relatively larger liquid droplets, and the pixel 132 constituted by the dots formed by the relatively smaller liquid droplets.

(Embodiment 4)

In the following there will be explained, with reference to FIGS. 12A to 12C, other effects obtained by a recording head suitable for the present invention.

It is conventionally known to provide a recording head or plural recording heads with nozzles for discharging relatively larger liquid droplets and those for discharging relatively smaller liquid droplets.

FIG. 12A illustrates a conventional configuration in which nozzles 110 for discharging relatively larger liquid droplets and nozzles 111 for discharging relatively smaller liquid droplets are provided as separate nozzle arrays in plural recording heads or a recording head. Also FIG. 12B illustrates a conventional configuration in which the nozzles 110 for discharging relatively larger liquid droplets and the nozzles 111 for discharging relatively smaller liquid droplets are alternately arranged in a nozzle array within a recording head.

Figure 12C:
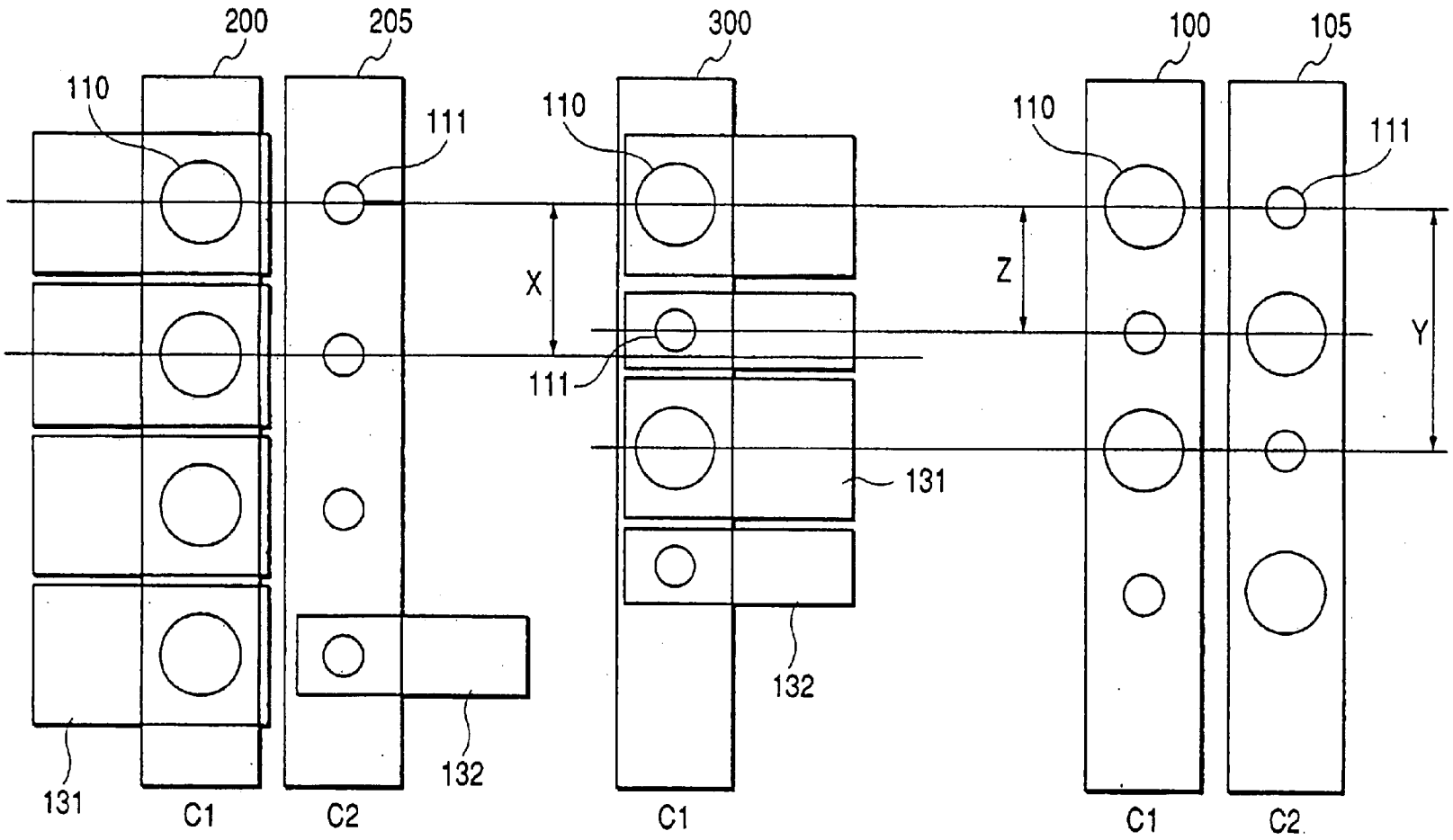

FIG. 12C shows an embodiment of the present invention, in which the nozzles 110 for discharging relatively larger liquid droplets and the nozzles 111 for discharging relatively smaller liquid droplets are alternately arranged in each nozzle array in plural recording heads or in a recording head.

In FIGS. 12A to 12C, an area 131 indicates the structure required for forming the relatively larger liquid droplet. More specifically, the area includes not only the nozzle 110 required for discharging liquid droplet, but also a heater member, circuits, an ink flow path (not shown) etc. required for ink discharge. Similarly an area 132 indicates the structure required for forming the relatively smaller liquid droplet. The area 131 required for discharging the relatively larger liquid droplet is naturally larger than the area 132 required for discharging the relatively smaller liquid droplet.

With the recent progress in the resolution of the recording head, there is commonly employed a resolution as high as 600 or 1200 dpi, but it is becoming very difficult to arrange the nozzles for discharging the relatively larger liquid droplets in a straight array corresponding to such high resolution, because the dimension required for the wall between the nozzles cannot be reduced though the nozzles and the heaters could be made smaller. Also in the actuator such as the heater, the energy conversion efficiency becomes inevitably lower in case of discharging the relatively smaller liquid droplet, so that the compactization of the liquid discharging mechanism is less efficient in comparison with the reduction of the liquid droplet size.

Because of the above-described facts, in the C1 nozzle array 200 shown in FIG. 12A, the pitch f the nozzles is limited to X because of the limitation by the area 131. In the C2 nozzle array 205, the pitch of the nozzles can be further reduced, but is limited according to the nozzle pitch X of the C1 nozzle array 200.

In the configuration shown in FIG. 12B, since the nozzles 110 for discharging the relatively larger liquid droplets and those 111 for discharging the relatively smaller liquid droplets are arranged alternately, such nozzles can be made smaller corresponding to a higher resolution. More specifically, it can be reduced to a distance Z. However, since the nozzle 110 for discharging the relatively larger liquid droplets and the nozzles 111 for discharging the relatively smaller liquid droplets are alternately arranged in the sub scanning direction, the pitch of the nozzles eventually becomes Y between the nozzles 110 for discharging the relatively larger liquid droplets or between the nozzles 111 for discharging the relatively smaller liquid droplets.

In the present embodiment, as shown in FIG. 12C, the recording heads, in which the nozzles 110 for discharging the relatively larger liquid droplets and the nozzles 111 for discharging the relatively smaller liquid droplets are alternately arranged in the sub scanning direction, are mutually displaced by a nozzle pitch between the nozzles for discharging liquid droplets of a same size. In this manner the nozzles of each liquid droplet size can be arranged in the sub scanning direction with a distance Z corresponding to the high resolution, and there can also be utilized the nozzles of relatively different liquid droplet sizes.

Such configuration is adopted in the foregoing embodiments, for achieving one-pass bidirectional printing at a high resolution. Also recording with a high resolution and with different droplet sizes can be achieved not only in the configuration of the above-described embodiment but also in a nozzle arrangement in which the nozzles of each color are arranged in a non-symmetrical manner.

In the foregoing embodiments, for forming dots of different droplets sizes, there are employed nozzles of different sizes for varying the amount of the liquid droplet to be discharged, but the present invention is not limited to such case. For example, the dots of different sizes may be formed for example by modulating the drive signal (voltage or pulse width) for ink discharge.

As explained in the foregoing, the present invention allows to alleviate the color unevenness resulting from the order of deposition of inks even in case of bidirectional printing by ink depositions with different amounts.

What is claimed is:

1. A print apparatus capable of forming a color image by applying ink materials of plural colors in different amounts onto a print medium while scanning a recording head in two directions, said apparatus comprising:

control means for applying plural ink materials for each pixel area to allow a gradation recording, the pixel area being a unit area for expressing thereon a primary color or a secondary color, wherein said control means applies ink materials on a pixel area for expressing thereon the secondary color area so that dots of the secondary color may be formed on plural positions of the pixel area while making different the orders of application of ink materials of plural colors used for expressing the secondary color, and conducts the gradation recording using a pattern of applying an ink material of relatively less amount on a diagonal position of the pixel area and a pattern of applying an ink material of relatively more amount on a diagonal position of the pixel area.

2. The print apparatus according to claim 1, wherein the ink material of another color is applied plural times onto the pixel area.

3. The print apparatus according to claim 2, wherein a plurality of dots of the secondary color are laid in different application orders of the ink material of the certain color and the ink material of the another color in the pixel area.

4. The print apparatus according to claim 1, wherein dots of the ink materials of the plural colors applied onto the pixel area overlap at least in part.

5. The print apparatus according to claim 1, wherein said recording head comprises a plurality of recording elements arranged in such a manner that recording elements for applying the ink material of the certain color are symmetric in a scanning direction with respect to the recording element for applying the ink material of the another color.

6. The print apparatus according to claim 5, wherein said recording head comprises recording elements for applying at least ink materials of cyan, magenta, and yellow and wherein with respect to a recording element corresponding to either one color the recording elements corresponding to the other colors are located in symmetry in the scanning direction.

7. The print apparatus according to claim 6, comprising a memory for storing data for selectively applying the ink materials of the plural colors onto the print medium in accordance with the color image, in correspondence to each of the plurality of recording elements.

8. The print apparatus according to claim 5, wherein said recording head comprises two sets of recording elements for applying at least ink materials of cyan, magenta, and yellow arranged in symmetry in the scanning direction.

9. The print apparatus according to claim 6 or 8, wherein said recording head further comprises a recording element for applying black ink.

10. The print apparatus according to claim 5, wherein the ink materials of the plural colors applied to the pixel area are applied by one scan of said recording head.

11. The printing apparatus according to claim 5, wherein, in said recording heads having symmetric arrangement, the recording elements for applying ink materials of different amounts are arranged alternately.

12. The printing apparatus according to claim 11, wherein, in said recording heads having symmetric arrangement, the recording elements for applying ink materials of the different amounts are arranged alternately and in a reverse order.

13. The print apparatus according to claim 1, wherein the ink materials of the plural colors applied to the pixel area are applied by plural scans in different directions of said recording head.

14. The print apparatus according to claim 1, comprising a memory for storing data for selectively applying the ink materials of the plural colors onto the print medium in accordance with the color image and for storing data for enabling the ink material of the certain color to be applied plural times onto the pixel area.

15. The print apparatus according to claim 14, wherein the memory is a print buffer.

16. The printing apparatus according to claim 1, capable of executing a first mode for applying ink materials with a relatively larger amount and a second mode for applying ink materials with a relatively smaller amount.

17. The printing apparatus according to claim 1, wherein the ink material of a relatively larger amount, the ink material of a relatively smaller amount and the ink materials of relatively larger and smaller amounts are applied onto the pixel area.

18. The print apparatus according to either one of claims 1 to 8 and 10 to 17, wherein said recording head ejects the ink materials by heat.

19. A print apparatus according to claim 1, wherein said control means conducts the gradation recording using a pattern of applying an ink medium of relatively less amount on a diagonal position of the pixel area, a pattern of applying an ink material of relatively more amount on a diagonal position of the pixel area, and a pattern of applying the ink material of relatively less amount and the ink material of relatively more amount on respectively different diagonal positions of the pixel area.

20. A print apparatus capable of forming a color image by applying ink materials of plural colors in different amounts onto a print medium while scanning a recording head in two directions, wherein, in order to make the order of application of an ink material of a certain color out of ink materials of plural colors applied in at least one kind of amount onto a pixel area for expressing thereon a process color using ink materials of plural color to form the process color, symmetric with respect to an ink material of another color, at least the ink materials of the certain color are applied onto the pixel area, and ink materials to be applied with relatively less amount are applied on diagonal positions of the pixel area, while ink materials to be applied with relatively more amount are applied on diagonal positions of the pixel area, different from the positions where the ink materials are applied with relatively less amount.

21. A print method capable of forming a color image by applying ink materials of plural colors in different amounts onto a print medium while scanning a recording head in two directions, said method comprising:

a first step of applying an ink material of a certain color for forming a secondary color in at least one kind of amount onto a pixel area for expressing thereon the secondary color;

a second step of applying in the amount onto the pixel area an ink material of another color for forming the secondary color in combination with the certain color, after the application of the ink material of the certain color; and a third step of applying the ink material of the certain color in the amount onto the pixel area, after the application of the ink material of the another color, wherein the ink materials are applied onto the pixel area so that dots of the secondary color may be formed at plural positions of the pixel area while making different the orders of application of the ink materials of plural colors for expressing the secondary color, and wherein the gradation recording is conducted using a pattern of applying an ink material of relatively less amount on a diagonal position of the pixel area and a pattern of applying an ink material of relatively more amount on a diagonal position of the pixel area.

22. The print method according to claim 21, wherein said recording head comprises two sets of recording elements for applying the ink material of the certain color, which are arranged in symmetry in a scanning direction with respect to a recording element for applying the ink material of the another color, and wherein said first to third steps are carried out by one scan of said recording head.

23. A print method capable of forming a color image by applying ink materials of plural colors in different amounts onto a print medium while scanning a recording head in two directions, said method comprising:

a first step of applying an ink material of a certain color for forming a secondary color onto a pixel area for expressing thereon the secondary color and applying an ink material of another color for forming the secondary color in combination with the certain color, the ink materials being applied in the order named, in at least one kind of amount onto the pixel area; and a second step of applying the ink material of the certain color and the ink material of the another color in an order symmetric with the order, in the amount onto the pixel area, wherein a position within the pixel area where the ink material is applied in said first step and a position within the pixel area where the ink material is applied in said second step are on a diagonal line, and ink materials to be applied with relatively less amount are applied on diagonal positions of the pixel area, while ink materials to be applied with relatively more amount are applied on diagonal points of the pixel area different from the positions where the ink materials are applied with relatively less amount.

24. The print method according to claim 23, wherein said recording head comprises two sets of recording elements for applying the ink material of the certain color and recording elements for applying the ink material of the another color arranged in symmetry in the scanning direction, and wherein said first step and said second step are carried out by one scan of said recording head.

25. The print method according to claim 24, wherein said first step and said second step are carried out by a plurality of scans in different directions of said recording head.

26. The printing apparatus capable of forming a color image by applying ink materials of plural colors in different amounts onto a print medium while scanning a recording head, wherein in said recording head, with respect to the ink material of at least one color, first and second arrays of recording elements, in which the recording elements for applying ink materials of different amounts are arranged with a predetermined pitch, are arranged in the direction of the scanning, and, in the first and second arrays of the recording elements, the recording elements for applying ink materials of a same amount are arranged with a displacement by the predetermined pitch in the direction of the array.

* * * * *

UNITED STATES PATENT AND TRADEMARK OFFICE

CERTIFICATE OF CORRECTION

PATENT NO. : 6,905,190 B1
DATED : June 14, 2005
INVENTOR(S) : Naoji Otsuka et al.

It is certified that error appears in the above-identified patent and that said Letters Patent is hereby corrected as shown below:

Column 7,
Line 2, “There” should read -- there --.

Column 8,
Line 10, “position 3” should read -- position 123 --; and
Line 18, “how” should read -- show --.

Column 10,
Line 47, “a” should read -- an --; and
Line 56, “conventional” should read -- conventionally --.

Column 12,
Line 11, “shown” should read -- shows --.

Column 13,
Line 4, “pitch f” should read -- pitch of --.

Column 14,
Lines 42, 47, 62 and 66, “printing” should read -- print --.

Column 15,
Line 4, “either” should read -- any --.

Column 16,
Line 32, “points” should read -- positions --; and
Line 45, “The” should read -- A --.

Signed and Sealed this

Twenty-fifth Day of October, 2005

JON W. DUDAS
*Director of the United States Patent and Trademark Office*